United States Patent [19]

Micha

[11] 4,450,511

[45] May 22, 1984

[54] SUBMERSIBLE HIGH INTENSITY LAMP

[75] Inventor: Peter Micha, Richmond Hill, Canada

[73] Assignee: Pem Fountain Co., Richmond Hill, Canada

[21] Appl. No.: 367,805

[22] Filed: Apr. 13, 1982

[51] Int. Cl.[3] ..... F21V 29/00

[52] U.S. Cl. ..... 362/267; 362/218; 362/294; 362/310; 362/373

[58] Field of Search ..... 362/267, 218, 294, 310, 362/373

[56] References Cited

U.S. PATENT DOCUMENTS

| | | | |
|---|---|---|---|
| 1,968,072 | 7/1934 | Creighton | 362/267 |
| 3,192,379 | 6/1965 | De Garmo | 362/267 |
| 3,339,066 | 8/1967 | Hart | 362/267 |
| 3,840,734 | 10/1974 | Oram | 362/267 |
| 3,949,213 | 4/1976 | Paitchell | 362/101 |
| 4,344,118 | 8/1982 | Rundquist | 362/267 |

*Primary Examiner*—Stephen J. Lechert, Jr.

[57] ABSTRACT

A water submersible light fixture for water fountains and the like comprises a light housing with concave light reflective surface, a light bulb positioned in the space defined by the concave light reflective surface and light bulb socket secured to a support which is sealingly engaged with the housing. The housing is submersed to cool and maintain the concave light reflective surface as exposed to the high temperatures produced by the light bulb. The positioning of the light bulb is predetermined by its length to locate the bulb relative to the reflective surface to provide the desired degree of light focus.

14 Claims, 5 Drawing Figures

SUBMERSIBLE HIGH INTENSITY LAMP

FIELD OF THE INVENTION

This invention relates to water submersible light fixtures, particularly those which may be used in water fountains, swimming pools and the like.

BACKGROUND OF THE INVENTION

Several different types of submersible light fixtures are available which are commonly used in water fountains to enhance the fountain display and in swimming pools to provide evening light. Sealed beam units are particularly effective for submersible lights. The sealed beam unit usually has a concave reflective surface made of glass and silver coated to reflect the light. The front face of the sealed unit is of glass and optionally has a face configured to provide either a focused or diffused type of beam. Submersible sealed beam units tend to be somewhat bulky in order to accommodate the size of the sealed beam. Unfortunately sealed beam units are not readiy available worldwide and in some instances, do not offer all voltage ranges which are used throughout the world, so that the design of submersible lighting units using sealed beams has been somewhat restrictive.

Other forms of submersible lighting involve standard incandescent light bulbs; however, they are of low intensity.

Another form of lighting, which provides high intensity, is the commonly referred to quartz-halogen type light bulb. These light bulbs are usually elongated or cylindrical in shape and are encased in a quartz bulb where the filament is emersed in a halogen gas. The output from these lights is of very high intensity; however, the lights operate at very high temperatures, such as 1700 to 1800 degrees F. In locating such lights in submersible fixtures, the reflective surfaces, which are commonly provided by a separate dish inserted into a housing, overheat. The reflective surface is burned off or discolored to the extent that the reflectivity is significantly reduced and thus the intensity of the light is lost.

Quartz-halogen lights have been used in swimming pool lights, where the housing for the light bulb is submersed in water to cool the housing. An example of such pool lights is the Model A400 fixture which may be obtained from PEM Fountain Company. This fixture has a truncated cone shaped housing in which the light is located. The heat from the light, in heating the planar truncated cone shaped surface, is dissipated by conduction into the pool water. The positioning of the light is fixed relative to the planar surface of the housing.

The submersible light fixture, according to this invention, overcomes the above problems in providing a compact light which is readily adjustable to vary the degree of light focus ranging from a spotlight to a floodlight.

SUMMARY OF THE INVENTION

A water submersible hermetically sealed light fixture comprises a light bulb housing having formed therein an interior concave light reflective surface. A light socket support is mounted on the housing beneath the reflective surface. The support is adapted for sealing engagement with the housing. An elongate high temperature operation light bulb is set in the light socket which is secured to the support. The housing has an aperture at the base of the reflective surface and is aligned with the light socket. The elongate light extends through the aperture into the spaced defined by the reflective surface, where the longitudinal axis of the bulb is coincident with the major axis of the concave reflective surface.

The housing, as submersed when used, is cooled by surrounding water to maintain the reflectivity of the concave light reflective surface, when exposed to the high temperatures produced by the operating light bulb.

The positioning of the light socket is predetermined by the length of the elongate bulb in locating the bulb relative to the concave reflective surface to provide the desired degree of focused light.

The light socket support may be interchangable so as to provide for various positionings of the light bulb relative to the concave reflective surface.

The housing may be cast from metal, such as bronze, and has the concave surface machined therein. The concave surface may be chrome plated to provide light reflection, where the cooling as effected by the water surrounding the housing prevents discoloring and damaging of the chrome plated reflective surface.

BRIEF DESCRIPTION OF THE DRAWINGS

Preferred embodiments of the invention are shown in the drawings wherein.

DETAILED DESCRIPTION OF THE PREFERRED EMBODIMENTS

Figure 1:
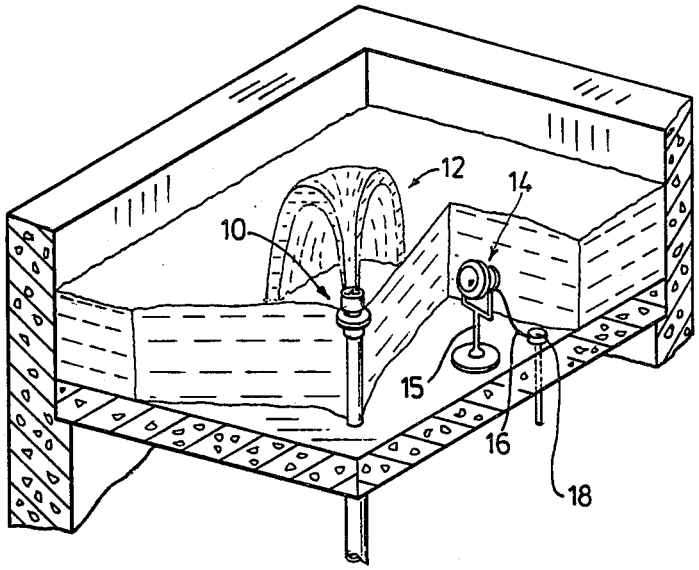
FIG. 1 is a perspective view of a fountain pool to show aspects of the lighting system.

One of the main concerns with any submersible light installation is to ensure that the water cannot in any way come into contact with the electrical wiring or leads to the light fixture. To accomplish this end, all submersible light fixtures are tightly or hermetically sealed. Because the units are sealed, heat buildup becomes a problem. This is normally dissipated by way of the light fixture being submersed in water. As noted, in using high temperature bulbs, heat dissipation becomes even more of a problem. The light fixture, according to this invention, has its concave reflective surface integral with the housing where heat is quickly conducted away from the surface to maintain its brilliance by avoiding discoloration due to overheating. Referring to FIG. 1, generally shown is a fountain nozzle and pump 10 which is powered to project upwardly into the air a fountain stream generally designated 12. As can be appreciated, such fountain streams may extend to several meters in height and throughout their operation, vary in terms of height. To illuminate and add color to the fountain stream, various types of submersible light fixtures 14 are provided. Each light fixture may be mounted in a vareity of ways, such as on a standard 15 which is connected to the lamp housing. Powering the light fixture 14 is cable 16 which is connected to an appropriate waterproof electrical box 18. It can be appreciated that, with varying heights of water stream, various focal lengths for the light beam are needed.

Figure 2:
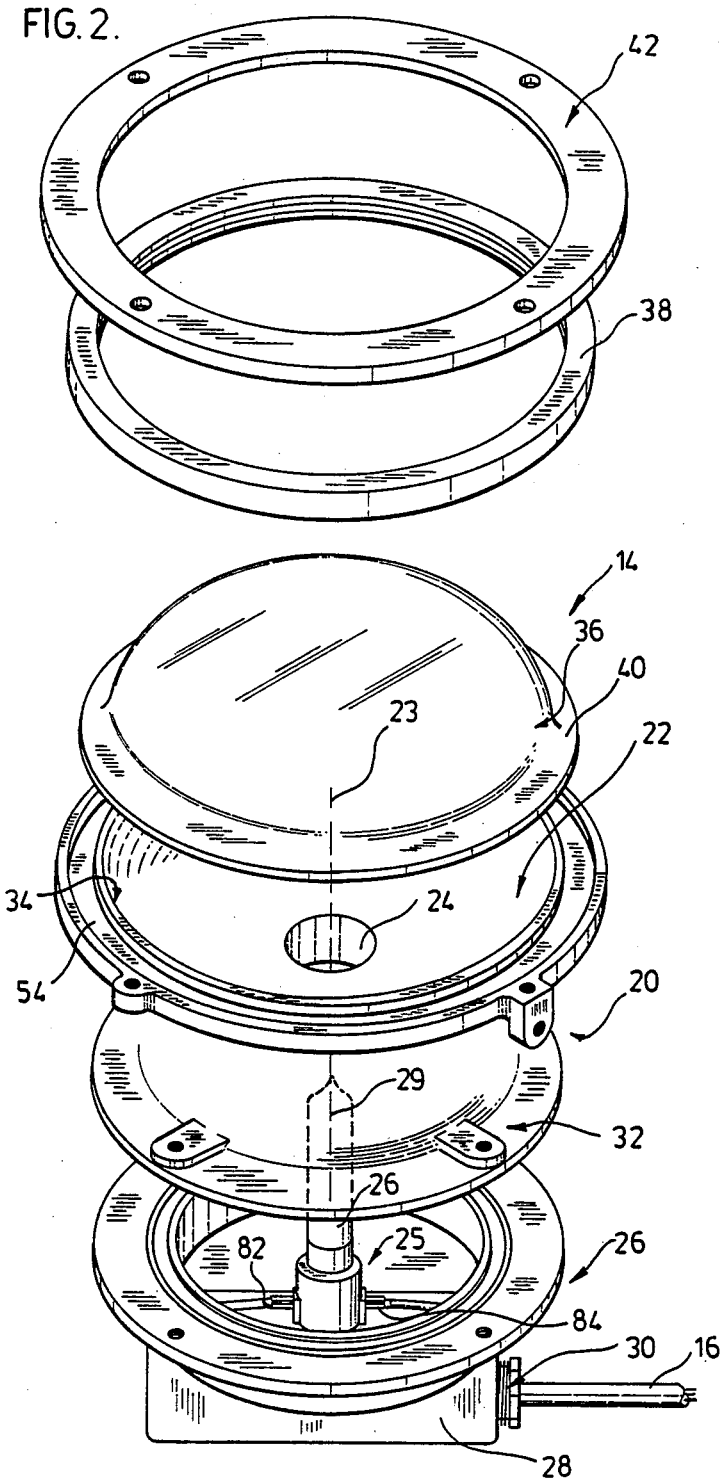
FIG. 2 is a exploded view of the light fixture according to a preferred embodiment of the invention.

Referring to FIG. 2, the light fixture 14 in disassembled form is shown. The light fixture consists of a housing 20, which has formed on its interior a concave reflective surface 22. An aperture 24 is located at the bottom or base portion of the concave reflective surface which is aligned with a socket 26 for the light bulb 28. The light bulb 28 extends through the aperture 24 into the space defined by the concave reflective surface. The longitudinal axis 29 of the bulb is coincident with the major axis 23 of the concave reflective surface 22.

A light socket support 26 has the light socket 24 secured thereto. The electrical cable 16 passes into the base portion 28 of the light socket and is sealed within the base of the support 26 by a standard type of compression washer-threaded nut arrangement 30. The socket support 26 is adapted to be sealingly engaged with the flaired flange portion 32 of the light housing 20. The open end of the housing generally designated 34 has sealingly engaged therewith a protective transparent cover portion 36. To form the seal with the housing upper portion, a rubber gasket 38 encases the flange portion 40 of the transparent protective cover and is clamped against the housing by compression ring 42. The manner of assembly of these components is shown in more detail in FIG. 3.

It can be seen from FIG. 2 that the light fixture is constructed in a manner so as to facilitate assembly and disassembly for bulb replacement, or socket replacement. In addition, the light socket support 26 is readily removable from the flaired flange portion of the housing 20 to facilitate replacement of this support.

Figure 3:
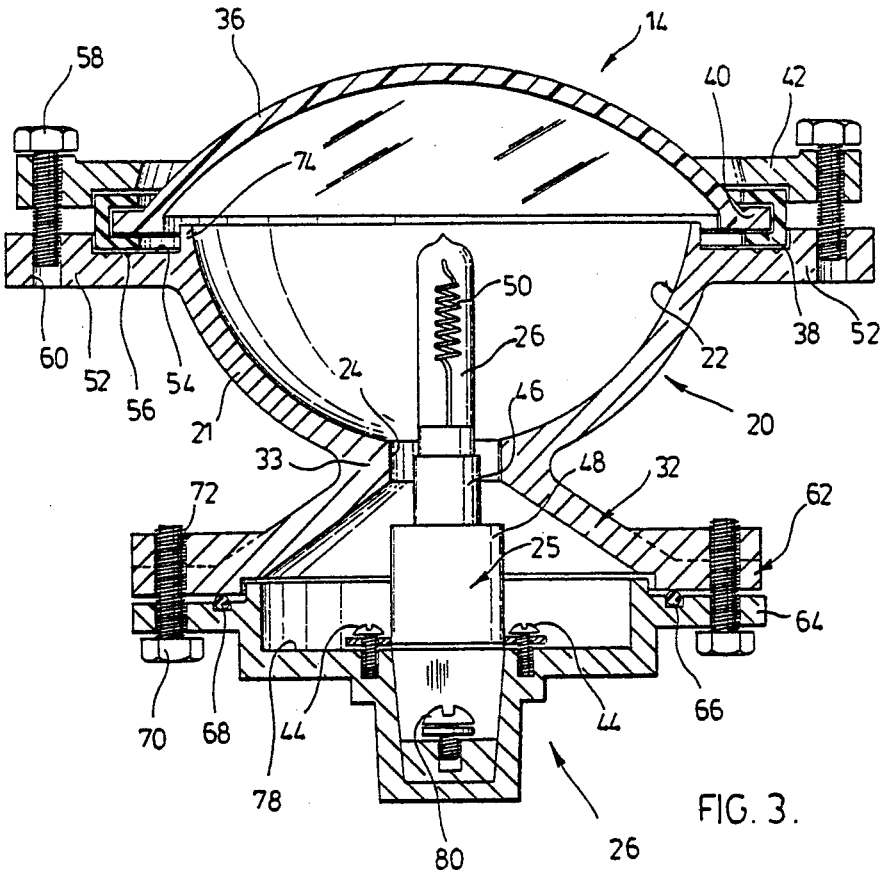
FIG. 3 is a cross-section through the assembled light fixture of FIG. 2.

Referring to FIG. 3, a cross-section of the assembled light fixture 14 is shown. The light housing 20 may be formed from various rigid materials; however, for water submersible use, a preferred material is bronze. The housing may be cast and have its internal surface 22 machined to provide the desired concave shape. After machining, the smooth surface 22 is chrome plated to provide the light reflectivity for the surface.

As mentioned and as more clearly shown in FIG. 3, the aperture 24 is aligned with the socket 25 which is secured to the light socket support 26 by way of threaded bolts 44. The bulb 26 has a high temperature resistant ceramic base portion 46 which is threaded into the ceramic recepticle 48 of the bulb socket 25. The bulb may be of the quartz-halogen type, that is the bulb enclosure is of quartz and the filament 50 of the bulb is immersed in a halogen gas. The color of the beam from the light may be altered by way of the protective cover 36. It may be of various colors to give off the desired glow of green, blue, red, yellow, purple and so on.

To ensure that the light fixture, with the open end 34 of the housing, is sealed, a gasket 38 encases the flange edge portion 40 of the lens cover 36. The compression ring 42 is used to clamp the gasket 38 against the ledge 52 of the housing 20. The ledge 52 has a recessed portion 54 which receives the gasket 38. The surface of the recess 54 has provided therein a plurality of V-shaped grooves 56. With the bolts 58 tightened in the threaded bores 60 of the ledges 52, the rubber gasket 38 is compressed into the grooves 56 to enhance and form a seal to prevent water entering the light housing.

To seal the bottom portion of the light fixture, an arrangement is provided whereby the light socket support 26 is adapted to sealingly engage the bottom of the housing 20. The housing 20 is provided with an outwardly flaired flange portion 32 which has a planar ledge portion 62. The light socket support 26 has a flange 64 which includes a recess 66 to receive a rubber O-ring 68. By tightening of the threaded bolt 70 into the threaded bore 72 of the ledge 62, the O-ring 68 is compressed against the ledge 62 to seal the light socket support 26 to the flaired base portion 32 of the light housing 20.

With the use of the quartz-halogen light, radiation is produced which, if directly exposed to the rubber gasket 38 such as a neoprene rubber, the gasket material is deteriorated and becomes ineffective as a seal. To prevent this deterioration of the rubber gasket, the reflective surface 22, as machined into the housing 20, is extended upwardly above the recess surface 54 to provide a lip 74 which extends around the entire perimeter of the reflective surface 22 to prevent any radiation from the light 26 impinging directly onto the gasket material 38.

With the light fixture 14 completely or hermetically sealed, it may be safely submersed in water. The light housing 20 has a wall portion 21 which, as mentioned, may be cast in bronze. The wall 21 is of substantially the same thickness about the portion which provides the reflective surface 22. With the housing 20 submersed, the heat from the light bulb 26, as it heats up the reflective surface 22, may be conducted away from the reflective surface 22 through the wall 21 to the surrounding cooling water. This direct conduction of heat away from the reflective surface 22 ensures that the surface does not become overheated to maintain the brilliancy of the chrome plated surface. Chrome is far less expensive then silver plating, albeit chrome is not as durable. The housing, as embodied by this invention, therefore, permits the use of the readily replacable high temperature bulb 26 with the water cooled concave form of reflective surface. The housing 20 in cross-section has an "hourglass" shape to provide a reduced neck portion 33 at the interconnection of the light reflective portion 21 with the flaired flange portion 22. The reduced volume of material in the neck portion 33 resists the conduction of heat from the wall 21 to the flaired flange portion 22 which can substantially reduce the temperature in the support, which carries the electrical wiring. Heat, which is conducted to the flaired portion, is taken away by the surrounding cooling water.

Figure 4:
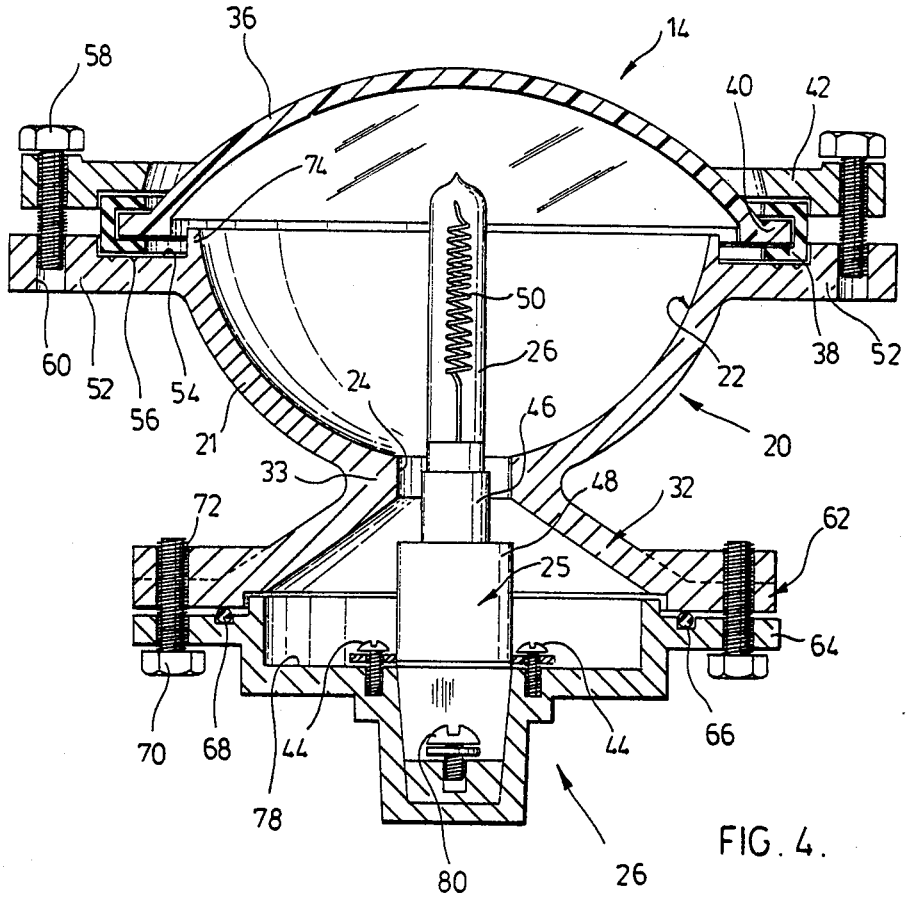
FIG. 4 is a cross-section through the light fixture with a different length bulb therein.

To vary the degree of focus of the light radiating from the light fixture, the position of the bulb 26 may be varied relative to the focal point of the concave reflective surface 22. This variation in positioning of the bulb relative to the reflective surface 22 may be accomplished in many ways. For example as shown in FIG. 4, a different length bulb 76 may be used in the same socket support 26. With a longer bulb, not all of its light radiation is focused. This provides a type of floodlight. The construction of the light fixture is the same as in FIG. 3, as indicated by like numeruls to designate the light fixture parts. The light socket 25 is secured to the light socket support by threaded bolts 44. The positioning of the socket 25 relative to the reflective surface 22 is determined by the location of ledge portion 78 of the socket 26. By varying the position of this ledge portion 78 relative to the reflective surface 22, one can vary the positioning of the light bulbs 26 or 76.

Figure 5:
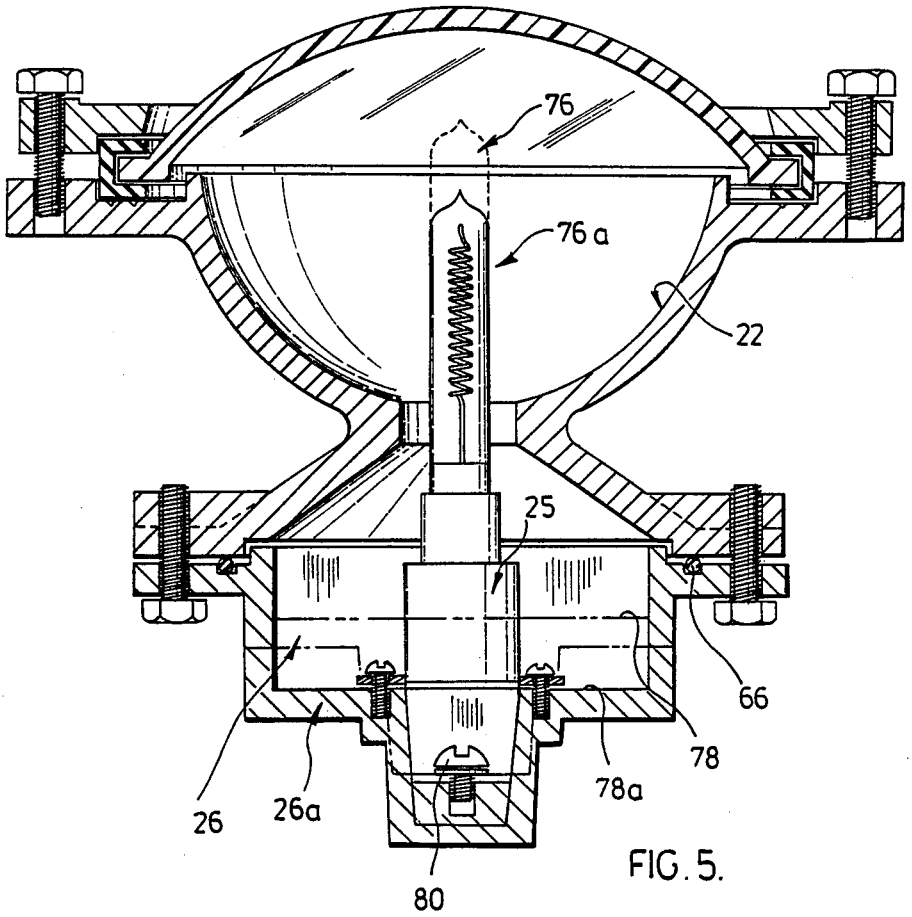
FIG. 5 is a cross-section of the light fixture showing two positions for the same length bulb as determined by two different light socket supports.

As shown in FIG. 5, two different positions for the ledge portion are shown as provided at 78 and 78*a*. For the same bulb 76, it has two positions as shown at 76 as the light socket 25 is resting on ledge 78 of the light support, and as shown in dot at a second position 76*a* with the light socket 25 resting on ledge 78*a* of socket support 26a. By providing interchangeable light socket supports 26, various positions for the light 76, relative to the reflective surface 22, may be provided depending upon the desired degree of light focus. Thus, only one housing need be made for the light fixture and by changing the bulb length or changing the light socket support, the positioning of the bulb relative to the surface 22 is provided.

As to other aspects of the light socket 26, as shown in FIG. 5, the O-ring seal 66 is retained. Only the ledge location in the socket 78 is varied. The ground terminal 80 remains the same in the various types of sockets, where the leads to the light socket 25 remain the same which are shown at 82 and 84 in FIG. 2.

The arrangement, according to this invention, in permitting the use of high temperature operation light bulbs provides for a selected degree of light focus ranging from a floodlight to a spotlight without having to change the reflective surface portion.

Although preferred embodiments of the invention have been described herein in detail, it will be understood by those skilled in the art that variations may be made thereto without departing from the spirit of the invention or the scope of the appended claims.

The embodiments of the invention in which an exclusive property or privilege is claimed are defined as follows:

1. A water submersible, hermetically sealed light fixture comprising a light bulb housing having formed therein an interior concave light reflective surface, a support for a light socket mounted on said housing beneath said reflective surface, said support being adapted for sealing engagement with said housing, an elongate high temperature operation light bulb replaceably set in said light socket which is secured to said support, said housing having an aperture at the base of said reflective surface and aligned with said light socket, a transparent cover for the open end of said housing which is sealingly mounted on said housing, said elongate light bulb extending through said aperture into the spaced defined by said reflective surface, the longitudinal axis of said bulb being coincident with the major axis of said concave surface, said housing being in direct contact with the water when in use to cool and maintain said concave light reflective surface as exposed to high temperature produced by said light bulb during operation, said light fixture being adapted to provide different degrees of focused light according to length of said light bulb and positioning of said light socket relative to said concave reflective surface.

2. A light fixture of claim 1, wherein said light socket support with said socket secured thereto determines said location of said bulb relative to said reflective surface.

3. A light fixture of claim 2, wherein said light socket support has a ledge portion to which said light socket is secured, said light socket support being replacable with other like light socket supports, said other supports differing from one another in the spacing of said ledge portion from said housing aperture, said spacing providing the desired variation in degree of focused light.

4. A light fixture of claim 1, wherein said degree of light focus ranges from a spotlight effect to a floodlight effect, said bulb extending slightly above the perimeter of the widest portion of said concave reflective surface when said floodlight effect is desired.

5. A light fixture of claim 1, wherein said transparent cover has a peripheral flange portion encased in a rubber gasket, clamp means being provided for clamping said rubber gasket against said housing to seal said cover to said housing, said housing having a circumferential lip portion projecting above said rubber gasket to prevent direct light radiation from said light bulb radiating said rubber gasket.

6. A light fixture of claim 5, wherein said lip is a continuation of said concave reflective surface which extends above said rubber gasket.

7. A light fixture of claim 1, wherein said light bulb is replacable with a different length bulb to vary the degree of said light focus.

8. A light fixture of claim 1, wherein said housing has a depending flaired flange portion to which said socket support is sealingly engaged to prevent entry of water, said flaired flange portion and socket support as submersed in water being cooled to prevent overheating of electrical wiring.

9. A light fixture of claim 8, wherein said housing is hourglass shaped to provide a reduced neck portion at the interconnection of said light reflective portion with said flaired flange portion, said aperture extending internally through said neck portion, the reduced volume of housing material at said neck portion resisting the conduction of heat from said light reflective portion to said flaired portion.

10. A light fixture of claim 1, wherein said housing is of cast metal having said concave surface machined therein, said machined surface being chrome plated to effectively reflect ight radiation from said light bulb.

11. A light fixture of claim 10, wherein said housing is cast from bronze.

12. A light fixture of claim 10 or 11, wherein said housing is of substantially uniform wall thickness in the area of sid reflective portion whereby heat conduction to surrounding water cools said chrome plated concave light reflective surface.

13. A light fixture of claim 1, wherein said elongate light bulb is a quartz-halogen bulb with threaded base for screw threading into correspondingly threaded light socket.

14. A light fixture of claim 6, wherein said housing has a recessed portion for receiving said gasket, said recess having a sealing surface provided with a plurality of circumferential grooves to enhance the sealing of siad gasket to said housing.

* * * * *